US010915038B2

(12) United States Patent
Kojima

(10) Patent No.: US 10,915,038 B2
(45) Date of Patent: Feb. 9, 2021

(54) IMAGE FORMING APPARATUS

(71) Applicant: CANON KABUSHIKI KAISHA, Tokyo (JP)

(72) Inventor: Takehiro Kojima, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/424,795

(22) Filed: May 29, 2019

(65) Prior Publication Data

US 2019/0286009 A1 Sep. 19, 2019

Related U.S. Application Data

(63) Continuation of application No. PCT/JP2017/043894, filed on Nov. 30, 2017.

(30) Foreign Application Priority Data

Dec. 1, 2016 (JP) ..... 2016-234195

(51) Int. Cl.
*G03G 15/06* (2006.01)
*G03G 15/11* (2006.01)
(Continued)

(52) U.S. Cl.
CPC ..... *G03G 15/065* (2013.01); *G03G 15/105* (2013.01); *G03G 15/11* (2013.01); *G03G 15/55* (2013.01)

(58) Field of Classification Search
CPC .... G03G 15/065; G03G 15/105; G03G 15/11; G03G 15/55
See application file for complete search history.

(56) References Cited

U.S. PATENT DOCUMENTS 7,929,882 B2 4/2011 Nakamura et al.
8,774,682 B2 7/2014 Bhattacharyya
(Continued)

FOREIGN PATENT DOCUMENTS

JP H10-268645 A 10/1998
JP H11-174853 A 7/1999
(Continued)

OTHER PUBLICATIONS

PCT International Search Report and Written Opinion dated Feb. 14, 2018, in PCT/JP2017/043894.
(Continued)

*Primary Examiner* — Gregory H Curran
(74) *Attorney, Agent, or Firm* — Venable LLP

(57) ABSTRACT

An image forming apparatus includes a controller for performing a mode, in which an image portion potential is controlled during image formation so that an absolute value of the image portion potential is a first value when a resistance value of a developing roller based on a value of a current flowing between the developing roller and an electroconductive member is smaller than a predetermined value when a predetermined potential difference between the developing roller and the electroconductive member is formed during non-image formation and so that an absolute value of the image portion potential is a second value smaller than the first value when a resistance value of the developing roller based on a value of current flowing between the developing roller and the electroconductive member is not smaller than the predetermined value when the predetermined potential difference between the developing roller and the electroconductive member is formed during non-image formation.

17 Claims, 8 Drawing Sheets

(51) Int. Cl.
*G03G 15/00* (2006.01)
*G03G 15/10* (2006.01)

(56) References Cited

U.S. PATENT DOCUMENTS

| | | | | |
|---|---|---|---|---|
| 8,792,796 | B2 | 7/2014 | Kella et al. | |
| 2006/0029430 | A1* | 2/2006 | Hosoya | G03G 15/11 399/249 |
| 2008/0076052 | A1* | 3/2008 | Nakamura | G03G 15/104 430/103 |
| 2010/0296825 | A1* | 11/2010 | Kella | G03G 15/105 399/31 |
| 2012/0148279 | A1* | 6/2012 | Soda | G03G 15/105 399/55 |
| 2015/0071665 | A1 | 3/2015 | Lam et al. | |
| 2016/0342108 | A1 | 11/2016 | Montag | |

FOREIGN PATENT DOCUMENTS

| | | | |
|---|---|---|---|
| JP | 2002-333778 | A | 11/2002 |
| JP | 2004-258154 | A | 9/2004 |
| JP | 2008-107787 | A | 5/2008 |
| JP | 2010-085462 | A | 4/2010 |
| JP | 2010-526338 | A | 7/2010 |
| JP | 2011-522285 | A | 7/2011 |

OTHER PUBLICATIONS

Takehiro Kojima, U.S. Appl. No. 16/424,767, Art Unit 2852.
Takehiro Kojima, U.S. Appl. No. 16/424,781, Art Unit 2852.

* cited by examiner (a)

(b)

IMAGE FORMING APPARATUS

This application is a continuation of PCT Application No. PCT/JP2017/043894, filed on Nov. 30, 2017.

TECHNICAL FIELD

The present invention relates to an image forming apparatus in which image formation is carried out by utilizing a developing device for developing an electrostatic image, carried on a latent image bearing member, through a wet developing type by using a liquid developer in which toner is dispersed in a medium liquid.

BACKGROUND ART

Electrophotography in which the electrostatic image formed on the latent image bearing member such as a photosensitive member is developed with charged (toner) and an image is formed has become widespread. As the electrophotography of this kind, for example, a dry developing method directly using powdery toner and a wet developing method (liquid developing system) using the liquid developer in which the toner is dispersed in a liquid exist. Of these, in the liquid developing system, the toner is dispersed in the medium (carrier) liquid, and therefore, image formation can be carried out by controlling particles with a particle size in a submicron order, and the liquid developing system is a promising developing method in terms of high image quality and high definition.

In the wet developing method, image formation is carried out by moving toner particles contained in the liquid developer to media by electrophoresis. In the wet developing method, specifically, in an opposing portion of a film forming electrode provided opposed to a developing roller, a developer containing an appropriate amount of the toner is formed in a film (layer) on the developing roller and a toner layer is formed on the developing roller by a squeeze roller. In a subsequent migration process, i.e., in respective processes of development, primary transfer and secondary transfer, basically, movement of all the toner (particles) is an image formation principal. Accordingly, on a density of an image formed on media, an application amount of the toner in the liquid developer formed in the film on the developing roller is reflected. Therefore, stable control of the application amount of the toner in the liquid developer carried on the developing roller is very important because the stable control leads to stabilization of an image quality over a long term.

As an image forming apparatus in which the application amount of the toner on the developing roller is controlled at a certain value, for example, an image forming apparatus including an optical sensor capable of detecting a surface of the developing roller has been known (see Japanese Laid-Open Patent Application (JP-A) Hei 10-268645). In this image forming apparatus, a liquid developer formed in a film on the developing roller under a predetermined condition is irradiated with light, and reflected light thereof is detected by the optical sensor, so that a concentration of the liquid developer is measured. Then, an acquired result is fed back to control of toner and carrier liquid amounts, a charge control agent amount and the like in a developing liquid tank, so that the application amount of the toner on the developing roller is controlled. According to this image forming apparatus, a concentration itself of the liquid developer on the developing roller is measured and is capable of being utilized in feed-back control, and therefore, as long as the measured developer concentration is proper, it is possible to stabilize the concentration of the liquid developer on the developing roller.

Incidentally, the developing roller used in the liquid developing system principally includes a shaft made of metal, in general, and a surface layer of an elastic member by a polymer or a rubber material, adjusted in electric characteristic (electroconductivity/resistivity) is provided. As the electric characteristic of the developing roller, volume resistivity of the developing roller is optimized by dispersing and mixing an ion conductive agent into an elastic (member) polymer constituting the surface layer. Before use of the developing roller, the ion conductive agent is uniformly dispersed in the surface layer of the developing roller, but during an image forming operation, different voltages are applied to the developing roller and a photosensitive drum or the like provided at a periphery thereof, and therefore, dispersion of the ion conductive agent gradually causes localization. Accordingly, the volume resistivity of the surface layer of the developing roller increases with use.

However, in the image forming apparatus of JP-A Hei 10-268645, a toner application amount is controlled by measuring a concentration of the liquid developer on the developing roller, and the localization is not met by detecting an increase in volume resistivity of the surface layer of the developing roller. For this reason, with the increase in volume resistivity of the surface layer of the developing roller, a shearing voltage of the surface layer of the developing roller in a developing nip between the developing roller and the photosensitive drum increases, and correspondingly, a voltage to be applied to the liquid developer becomes small compared to a desired value. Further, when the shearing voltage exceeds a predetermined threshold, it becomes difficult to acquire a proper developing contrast ($\Delta V_cont$) and a proper fog-removing voltage ($\Delta V_back$) even when a surface potential of the photosensitive drum and the applied voltage of the developing roller are set at predetermined values. As a result thereof, there is a liability that image defects, such as insufficient density and fog, in image formation.

Moreover, in the image forming apparatus of JP-A Hei 10-268645, the surface of the developing roller is measured utilizing an optical sensor, so that by use of the image forming apparatus for a long term, surface roughness of the developing roller increases with use and reflected light intensity changes. For this reason, in a measuring method using reflected light, it is difficult to detect the toner concentration of the liquid developer on the developing roller over a long period, and as a result, there is a liability that the image defects are caused.

The present invention aims at providing an image forming apparatus capable of suppressing an occurrence of image defects even in use for a long period in the image forming apparatus using a liquid developing system.

Means for Solving the Problems

According to an aspect of the present invention, there is provided an image forming apparatus comprising: an image bearing member; a charging portion for electrically charging the image bearing member; an exposure portion for exposing the charged image bearing member to light to form an electrostatic latent image; a rotatable developing roller, including an electroconductive layer containing an electroconductive agent, for developing the electrostatic latent image while carrying a liquid developer containing toner and a carrier liquid; an electroconductive member for urging the developing roller; voltage applying means for forming a potential difference between the developing roller and the electroconductive member; current detecting means for detecting a current flowing through between the developing roller and the electroconductive member; and a controller for changing an image portion potential on the basis of a current value detected by the current detecting means when a predetermined potential difference is formed between the developing roller and the electroconductive member.

Effect of the Invention

According to the present invention, in the image forming apparatus using the liquid developing system, even use for the long period, the occurrence of the image defects can be suppressed.

Figure 10:
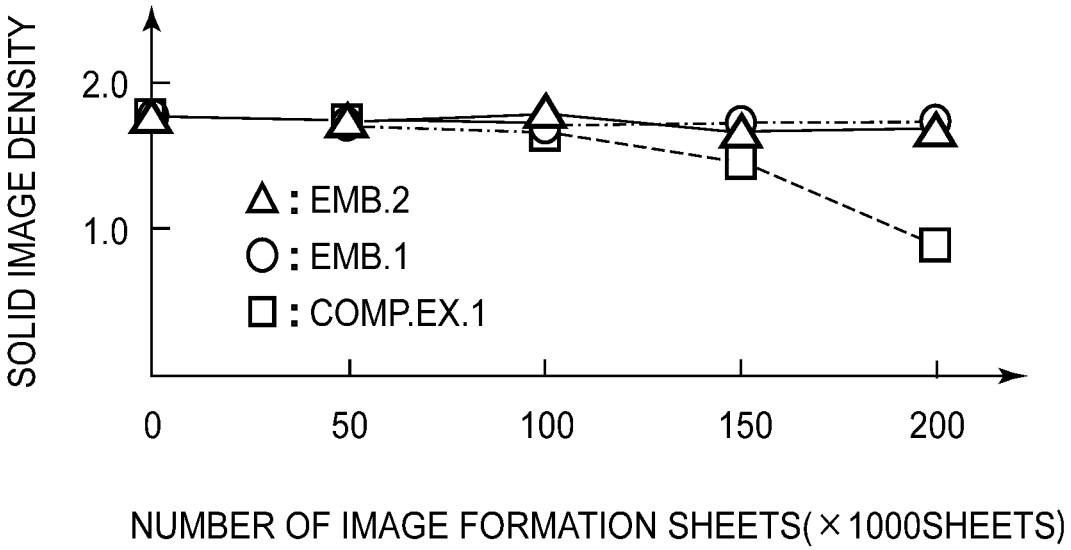
Figure 10:
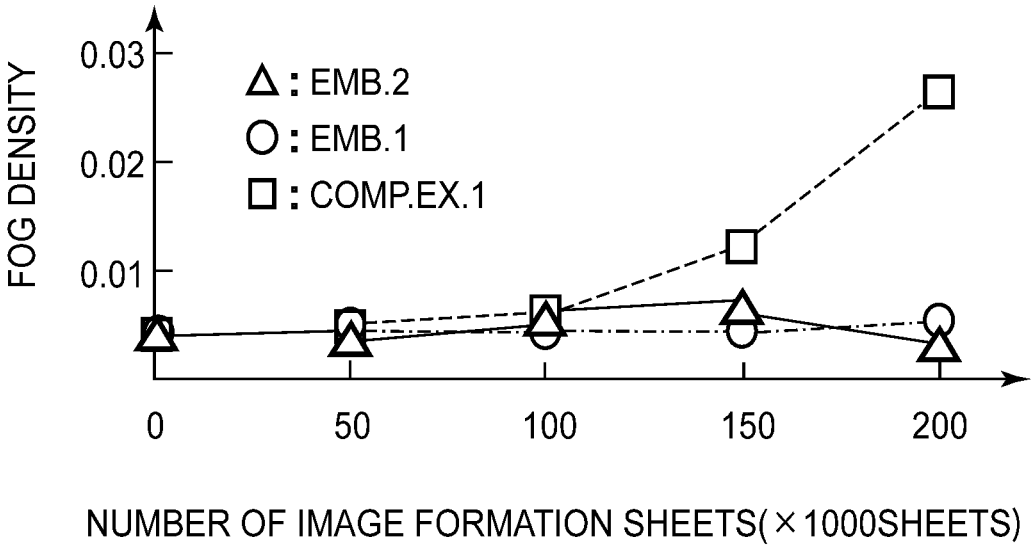

Part (a) of FIG. 10 is a graph showing a relationship between a number of image formation sheets and a solid image density in image forming apparatuses according to the First Embodiment, and part (b) of FIG. 10 is a graph showing a relationship between a number of image formation sheets and a fog density in image forming apparatuses according to the Second Embodiment.

EMBODIMENTS FOR CARRYING OUT THE INVENTION

First Embodiment

In the following, the First Embodiment of the present invention will be specifically described while making reference to FIGS. 1 to 8. An image forming apparatus 1 of this embodiment is a digital printer of an electrophotographic type in which a toner image formed using a liquid developer containing toner and a carrier liquid is formed on a recording material. In this embodiment, as an example of the image forming apparatus 1, a full-color printer of a tandem type is described. However, the present invention is not limited to the image forming apparatus 1 of the tandem type but may also be an image forming apparatus of another type. Further, the image forming apparatus is not limited to the image forming apparatus for a full-color image, but may also be an image forming apparatus for a monochromatic image or an image forming apparatus for a mono-color (single color) image. Or, the image forming apparatus can be carried out in various uses, such as printers, various printing machines, copying machines, facsimile machines and multi-function machines.

Figure 1:
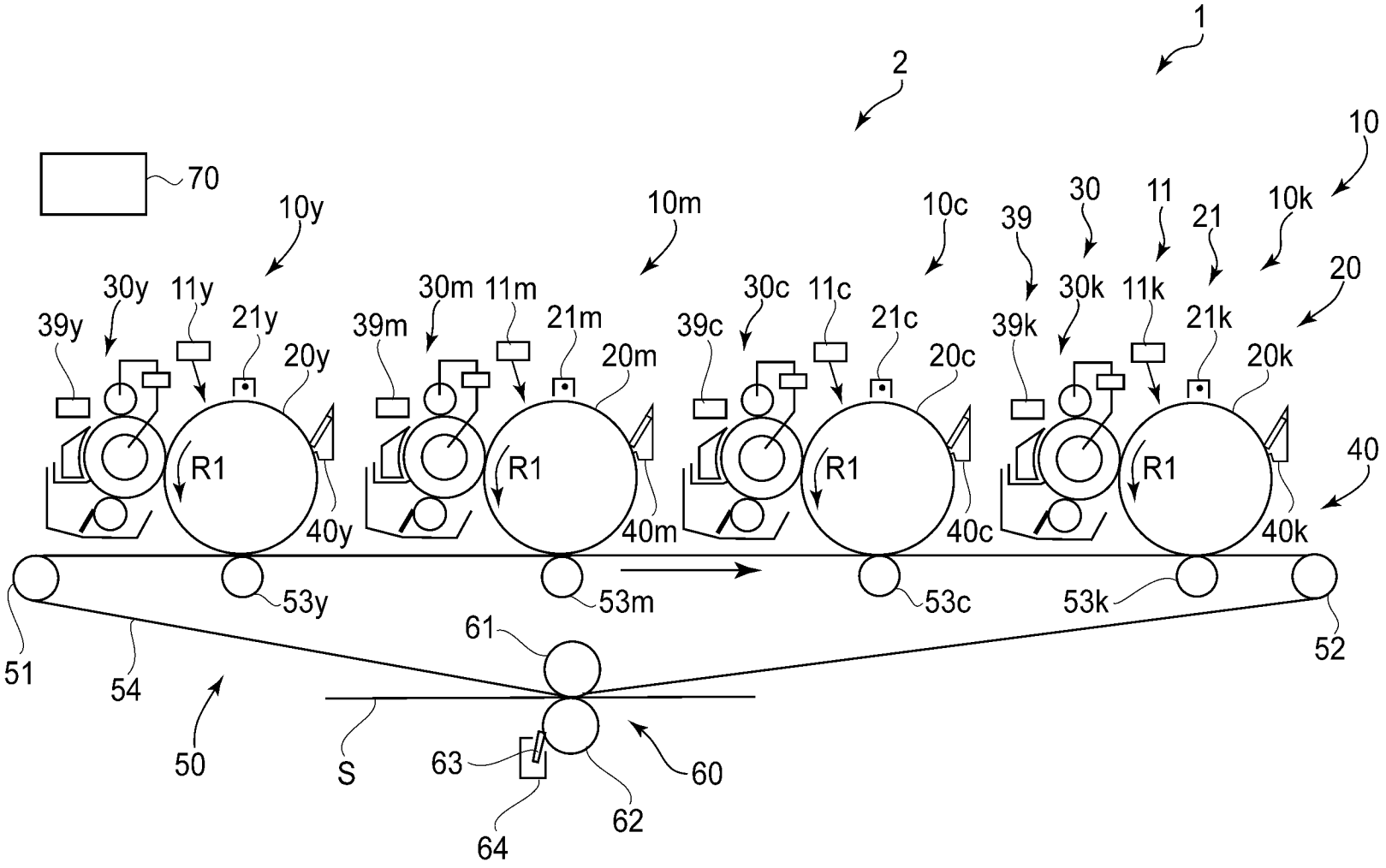
FIG. 1 is a schematic sectional view showing an image forming apparatus according to a First Embodiment.

As shown in FIG. 1, the image forming apparatus 1 includes an image forming portion 2 and a controller 70, and in addition, includes an unshown sheet feeding portion, an unshown sheet conveying portion and an unshown sheet discharging portion. Further, on a front-side upper surface of an apparatus main assembly of the image forming apparatus 1, for example, a display device 3 comprising a liquid crystal panel is provided (see FIG. 3). The image forming apparatus 1 capable of forming a full-color image of four colors is formed on the recording material depending on an image signal from an unshown original reading device, an unshown host device such as a personal computer, or an unshown external device such as a digital camera or a smartphone. Incidentally, on a sheet S as the recording material, the toner image is to be formed, and specific examples of the sheet S may include plain paper, a resin-made material sheet as a substitute for the plain paper, thick paper, a sheet for an overhead projector, and the like.

The image forming portion 2 includes image forming units 10*y*, 10*m*, 10*c*, 10*k*, laser scanners 11*y*, 11*m*, 11*c*, 11*k*, an intermediary transfer unit 50, a secondary transfer unit 60 and an unshown fixing device. Incidentally, the image forming apparatus 1 in this embodiment meets full-color image formation, and the image forming units 10*y*, 10*m*, 10*c*, 10*k* have similar constitutions for four colors of yellow (y), magenta (m), cyan (c), black (k), respectively, and are separately provided. For this reason, in FIG. 1, respective constituent elements for the four colors are represented by adding identifiers for the colors subsequently to the same symbols, but in FIG. 2 and in the specification, are described using only the symbols without adding the identifiers for the colors in some cases.

The image forming unit 10 includes photosensitive drums 20*y*, 20*m*, 20*c*, 20*k*, which are capable of carrying toner images and which move, chargers 21*y*, 21*m*, 21*c*, 21*k*, and developing devices 30*y*, 30*m*, 30*c*, 30*k*. Further, the image forming unit 10 includes developer mixers 39*y*, 39*m*, 39*c*, 39*k* and drum cleaners 40*y*, 40*m*, 40*c*, 40*k*. Similarly as the image forming unit 10, these have the same constitution for the four colors of yellow (y), magenta (m), cyan (c), black (k), respectively, and are separately provided. For this reason, in FIG. 1, respective constituent elements for the four colors are represented by adding the identifiers for the colors subsequently to the same symbols. The image forming unit 10 is integrally assembled into a unit as a cartridge and is constituted so as to be mountable in and dismountable from the apparatus main assembly of the image forming apparatus 1.

The photosensitive drum 20 (image bearing member) is a drum-like electrophotographic photosensitive member including a cylindrical base material and a photosensitive layer which is formed on an outer peripheral surface of the base material and which is constituted by an organic photosensitive member or an amorphous silicon photosensitive member or the like, and is rotated about a center axis in an arrow R1 direction in the figures by an unshown drum motor. In this embodiment, as the photosensitive layer of the photosensitive drum 20, an amorphous silicon photosensitive layer is used. A width of the photosensitive drum 20 is made broader than a width of a developing roller (see FIG. 2) described later. The photosensitive drum 20 circulates and moves while carrying an electrostatic image formed on the basis of image information when an image is formed. The photosensitive drum 20 is movable while carrying a toner image formed using a liquid developer. Incidentally, in this embodiment, the photosensitive drum 20 is grounded.

The charger 21 (charging means) is provided substantially in parallel to the center axis of the photosensitive drum 20 and electrically charges a surface of the photosensitive drum 20 uniformly to a negative potential (dark portion potential VD) of the same polarity as negatively chargeable toner by a developing bias. Further, as the charger 21, a corona charger is used. However, as the charger 21, it is not limited to the corona charger, but a charging roller or the like may also be applied.

The laser exposure device (exposure means) 11 subjects the surface of the photosensitive drum 20 charged to the dark portion potential VD, to exposure by irradiation with laser light on a side downstream of the charger 21 with respect to an R1 direction and causes a potential drop to a light portion potential VL at an exposure portion, so that the electrostatic image is formed on the surface of the photosensitive drum 20. In this embodiment, the laser exposure device 11 irradiates the photosensitive drum surface with the laser light modulated depending on an image signal of an original, so that the laser light is projected onto the surface of the photosensitive drum 20 via an unshown polygon mirror, an unshown f-θ lens and the like.

The developing device 30 is a device for developing the latent image, formed on the photosensitive drum 20, with liquid toner. Details of the developing device 30 will be described later. The developer mixer 39 supplies the liquid developer to the developing device 30 and includes a developer concentration sensor (toner concentration detecting means) 39*a* (see FIG. 2) capable of detecting the toner concentration of the liquid developer to be supplied to the developing roller 31. The developer concentration sensor 39*a* is, for example, a sensor utilizing light transmission and is used for calculating a weight percentage concentration (T/D) [wt %] of the toner to the liquid developer supplied from the developer mixer 39. Incidentally, in this embodiment, the case where the developer concentration sensor 39*a* is a sensor utilizing light transmission was described, but the present invention is not limited thereto, and for example, a sensor utilizing an electric resistance or the like may also be used.

The drum cleaner 40 is disposed on a side downstream of a primary transfer portion described later with respect to the R1 direction and includes a cleaning blade 41 (see FIG. 2). The cleaning blade 41 is contacted to the photosensitive drum 20 at a predetermined angle and a predetermined pressure by an unshown pressing means, so that the liquid developer remaining on the photosensitive drum 20 is scraped off by the cleaning blade 41 and prepares for a subsequent process.

The intermediary transfer unit 50 includes a plurality of rollers such as a driving roller 51, a follower roller 52, and primary transfer rollers 53*y*, 53*m*, 53*c* and 53*k*, and includes the intermediary transfer belt 54 which is wound around these rollers and which is an endless belt for carrying the toner image. The primary transfer rollers 53*y*, 53*m*, 53*c*, 53*k* are disposed opposed to the photosensitive drums 20*y*, 20*m*, 20*c*, 20*k*, respectively, and contact the intermediary transfer belt 54, so that the toner images on the photosensitive drums 20 are primary-transferred onto the intermediary transfer belt 54 which is another image bearing member.

The intermediary transfer belt 54 forms the primary transfer portion between itself and the photosensitive drum 20 in contact with the photosensitive drum 20, and a primary transfer bias is applied to the intermediary transfer belt 54, whereby the toner image formed on the photosensitive drum 20 is primary-transferred at the primary transfer portion. A positive-polarity transfer bias is applied to the intermediary transfer belt 54 by the primary transfer rollers 53, whereby the toner images having the negative polarity on the photosensitive drums 20 are superposedly transferred successively onto the intermediary transfer belt 54.

The secondary transfer unit 60 includes a secondary transfer inner roller 61, a secondary transfer outer roller 62, an outer roller blade 63 and a cleaning liquid collecting portion 64. By applying a positive-polarity secondary transfer bias to the secondary transfer outer roller 62, a full-color toner image formed on the intermediary transfer belt 54 is transferred onto the sheet S. The secondary transfer outer roller 62 forms the secondary transfer portion between itself and the intermediary transfer belt 54 in contact with the intermediary transfer belt 54, and a secondary transfer bias is applied to the secondary transfer outer roller 62, whereby the toner images, primary-transferred on the intermediary transfer belt 54, are secondary-transferred onto the sheet S by the secondary transfer unit 60.

The unshown fixing portion includes a fixing roller and a pressing roller, and the sheet S is nipped and fed between the fixing roller and the pressing roller, so that the toner images transferred on the sheet S are pressed and heated and thus are fixed on the sheet S.

Figure 2:
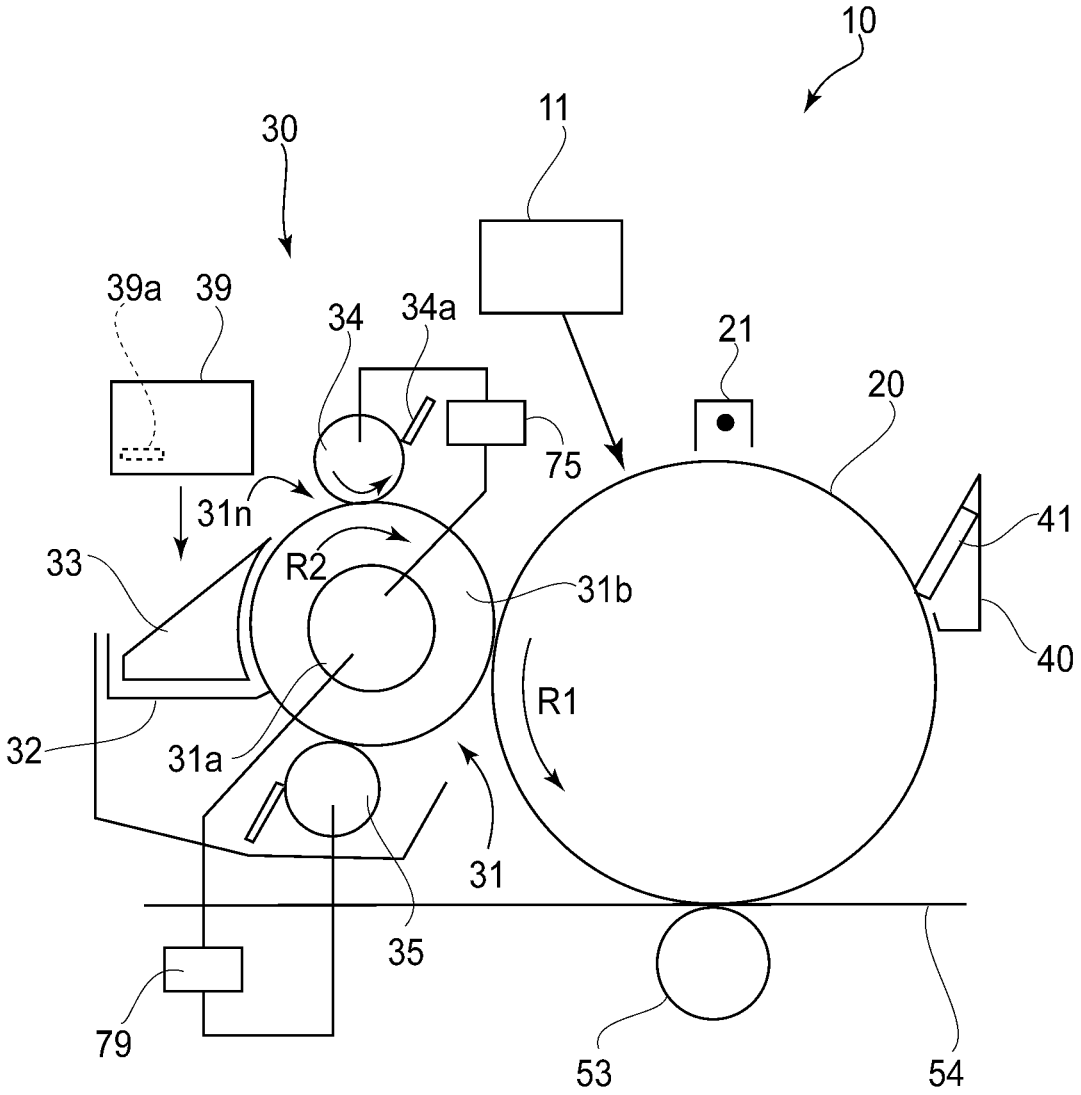
FIG. 2 is a schematic sectional view showing an image forming unit of the image forming apparatus according to the First Embodiment.

Next, a constitution of the developing device 30 in this embodiment will be specifically described using FIG. 2. The developing device 30 includes the developing roller 31 (developer carrying member) for feeding the liquid developer toward the photosensitive drum 20 while carrying the liquid developer, a developing liquid tank 32, a film forming electrode 33, a squeeze roller (electroconductive member) 34 and a cleaning roller 35.

The developing roller 31 is a cylindrical member of 45 mm in diameter and rotates about a center shaft 31*a* in a rotational direction R2. The developing roller 31 includes a 5 mm-thick surface layer 31*b* (electroconductive layer) formed of an elastic member by an electroconductive polymer or the like on an outer peripheral portion of the center shaft 31*a* which is an inner core made of metal such as stainless steel. The developing roller 31 is disposed opposed to the photosensitive drum 20 so as to form a number between itself and the photosensitive drum 20, and at the nip, a developing nip is formed. In this embodiment, the surface layer 31*b* of the developing roller 31 is made of an electroconductive urethane rubber, and in an initial state, inside the surface layer 31*b*, an ion conductive agent is uniformly dispersed, so that volume resistivity is adjusted. That is, the developing roller 31 is formed by containing the electroconductive agent and is movable while carrying the liquid developer containing the toner and the contact, and develops the electrostatic image of the photosensitive drum 20 by application of a developing bias. Incidentally, to the developing roller 31, a developing roller voltage source 73 (see FIG. 3) capable of applying a voltage is connected.

As a material of the surface layer 31*b* of this developing roller 31, for example, the following materials are applied. First, an appropriate resin is selected from EPDM, urethane, silicone, nitrile-butadiene rubber, chloroprene rubber, styrene-butadiene rubber, butadiene rubber, and the like. Then, into this selected resin, as an electric resistance adjusting material, electroconductive particles, for example, either one or a plurality of carbon (back) and titanium oxide are used, and are dispersed and mixed, and it is appropriate to use a material based on a dispersion-type resistance-adjusting resin. Further, in the case where a foaming material is used as a foaming and mixing step for obtaining elasticity, it is appropriate to use a silicone-based surfactant (for example, polydiallylsiloxane, polysiloxane-polyalkyleneoxide block copolymer). Incidentally, at the surface layer 31*b* comprising these materials, in general, the volume resistivity is adjusted to $1\times10^{2}$-$1\times10^{12}$ Ω·cm inclusive of a variation, and the volume resistivity of the developing roller 31 used in this embodiment is adjusted to 1 to $5\times10^{5}$ Ω·cm in an initial state.

The developing liquid tank 32 is disposed on a side substantially opposite from the photosensitive drum 20 with the developing roller 31 as a center, and accommodates the liquid developer for developing the latent image formed on the photosensitive drum 20. The liquid developer used in this embodiment is formed by adding particles of 0.8 μm in average particle size of a colorant such as a pigment into a polyester-based resin, together with a dispersing agent, a toner charge control agent and a charge directing agent into the liquid carrier such as an organic solvent of an isoparaffine type. Further, the liquid developer in this embodiment is about 7 wt % in concentration of the toner particles. Incidentally, in this embodiment, the surfaces of the toner particles are charged to the negative polarity in a certain amount.

The film forming electrode 33 contacts the liquid developer stored in the developing liquid tank 32 and is disposed closed and opposed to the developing roller 31 with a gap from the developing roller 31. The liquid developer enters between the film forming electrode 33 and the developing roller 31, and the liquid developer is formed in a film (layer) on the developing roller 31, and in addition, a potential difference is set between the film forming electrode 33 and the developing roller 31, whereby the film is formed so that a toner concentration of the liquid developer carried on the developing roller 31 is adjustable. In this embodiment, the potential difference between the film forming electrode 33 and the developing roller 31 is adjusted so that the toner concentration of the liquid developer after passing through the film forming electrode 33 is 15.0±3.0 wt %. Incidentally, to the film forming electrode 33, a film forming electrode voltage source 81 (see FIG. 3) capable of applying a voltage is connected.

The squeeze roller 34 is disposed on a side downstream of the film forming electrode 33 with respect to a rotational direction R2 and is disposed in contact with the developing roller 31 through at least the carrier liquid. The squeeze roller 34 shifts the toner particles, contained in the liquid developer formed in a film (layer) on the developing roller, toward the developing roller 31 side by application of a voltage, and in addition, an excessive carrier liquid is squeezed and collected, so that the concentration of the liquid developer carried on the developing roller 31 is adjustable. The squeeze roller 34 is a cylindrical member made of metal in a diameter of 40 mm, and in this embodiment, a roller prepared by a stainless steel is used. The squeeze roller 34 is contacted to the developing roller 31 so that a pressure is constant (almost 80 kPa in this embodiment) over a longitudinal length of almost 300 mm, and rotates about a center axis in an arrow direction. Incidentally, to the squeeze roller 34, a squeeze roller voltage source 74 (see FIG. 3) capable of applying a voltage is connected.

The liquid developer which is drawn up from the developing liquid tank 32 and which passed through the film forming electrode 33 is carried on the developing roller 31 in a certain amount. For that reason, the liquid developer fed at a predetermined speed to a contact portion between the squeeze roller 34 and the developing roller 31 stably forms a nip 31*n* of almost 6 μm in gap and almost 5 mm in width. The liquid developer is adhered to and separated from the respective rollers 34 and 31 on an open side of the nip 31*n* between the squeeze roller 34 and the controller 31. As described later, a predetermined potential difference is set between both the rollers 34 and 31 so as to perform an operation in which the toner shifts toward the developing roller 31 side. For this reason, the toner concentration in the liquid developer at the surface of the developing roller 31 after passing through between the rollers 34 and 31 is about twice the toner concentration before passing through between the rollers 34 and 31, i.e., 30.0±5.0 wt %.

The cleaning roller 35 is disposed in contact with the developing roller 31 on a side downstream of the developing nip (developing position) between the developing roller 31 and the photosensitive drum 20 with respect to the rotational direction R2. The cleaning roller 35 is a roller made of metal or the like, and removes the liquid developer, carried and remaining on the surface of the developing roller 31, in contact with the developing roller 31. That is, the cleaning roller 35 is disposed on a side downstream of the developing nip on the developing roller 31 with respect to a movement direction and removes the liquid developer carried on the developing roller 31.

Figure 3:
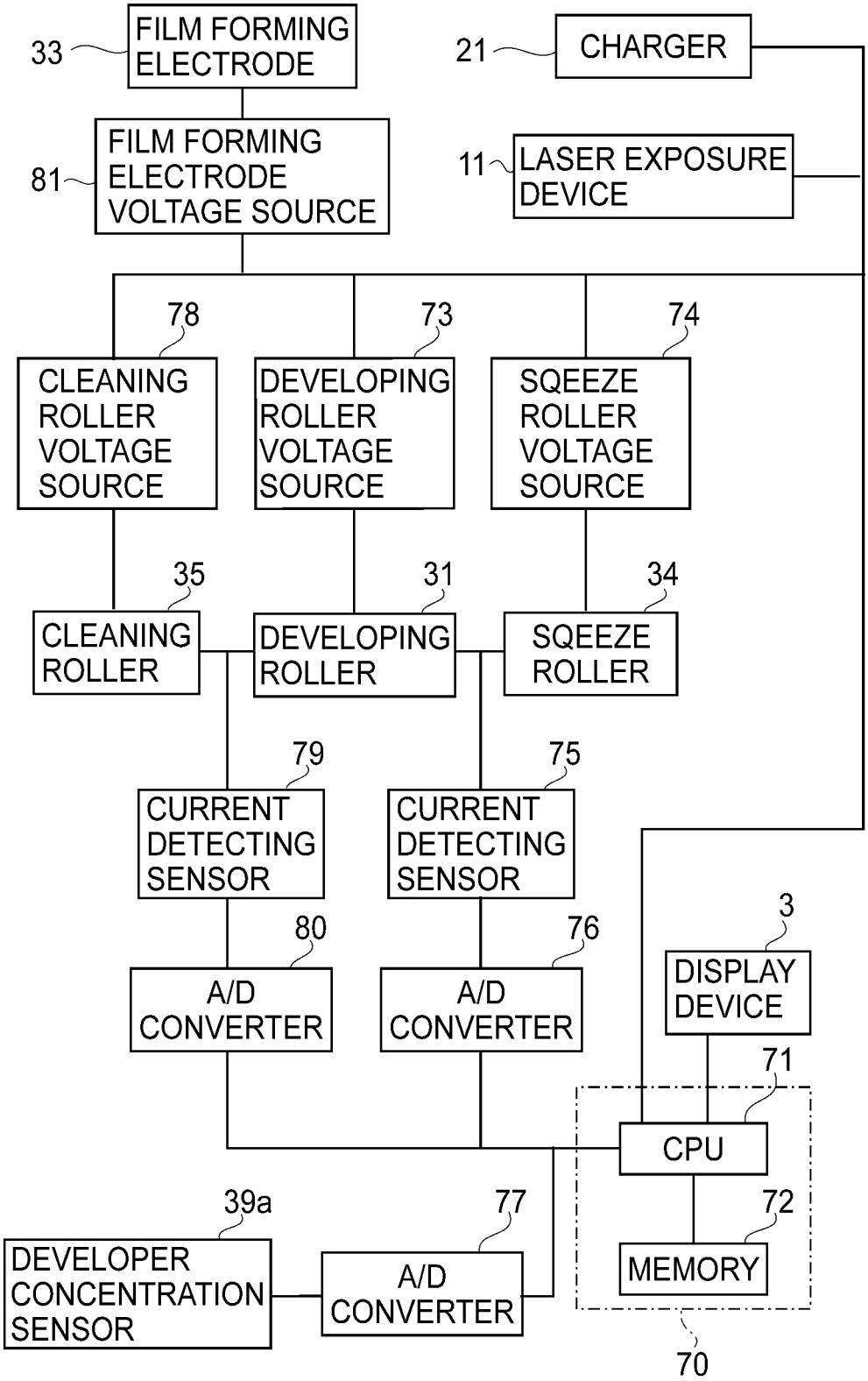
FIG. 3 is a schematic illustration showing a control block diagram of the image forming apparatus according to the First Embodiment.

As shown in FIG. 3, the controller 70 is constituted by a computer and is provided with, for example, a CPU 71, a memory 72 and an unshown input and output circuit for inputting and outputting signals between itself and an outside portion. The memory 72 includes a ROM for storing programs for controlling respective portions and includes a RAM for temporarily storing data. The CPU 71 is a microprocessor managing entirety of control of the image forming apparatus 1 and is a main body of a system controller. The CPU 71 is connected to the respective portions of the image forming apparatus 1, such as the image forming portion 2, through the input and output circuit, and not only transfers the signals between itself and the respective portions but also controls operations of the respective portions. In the ROM of the memory 72, an image formation control sequence for forming the image on the sheet S and the like are stored.

To the developing roller 31, a developing roller voltage source (first voltage applying means) 73 is connected, and to the squeeze roller 34, a squeeze roller voltage source (second voltage applying means) 74 is connected, and to the cleaning roller 35, a cleaning roller voltage source 78 is connected. Further, to the film forming electrode 33, the film forming electrode voltage source (third voltage applying means) 81 is connected. These voltage sources 73, 74, 78 and 81 are connected to the CPU 71 and are controlled by the CPU 71. That is, the developing roller voltage source 73 and the squeeze roller voltage source 74 are capable of generating a potential difference between the developing roller 31 and the squeeze roller 34. Further, the developing roller voltage source 73 and the film forming electrode voltage source 81 are capable of generating a potential difference between the developing roller 31 and the film forming electrode 33. Incidentally, the photosensitive drum 20 is grounded, and therefore, the developing roller voltage source (second voltage applying means) 73 is capable of generating the potential difference between the developing roller 31 and the photosensitive drum 20.

Between the developing roller 31 and the squeeze roller 34, a current detecting sensor (current detecting means) 75 for detecting a current passing through between these developing roller 31 and squeeze roller 34 is provided. A signal detected by this current detecting sensor 75 is inputted to the CPU 71 through an A/D converter 76. Between the developing roller 31 and the cleaning roller 35, a current detecting sensor 79 for detecting a current flowing through between the developing roller 31 and cleaning roller 35 is provided. A signal detected by this current detecting sensor 79 is inputted to the CPU 71 through an A/D converter 80. Further, a signal detected by the developer concentration sensor 39*a* of the developer mixer 39 is inputted to the CPU 71 through an A/D converter 77.

The controller 70 is capable of controlling the respective voltage sources 73, 74, 78 and 81, the charger 21, the laser exposure device 11, and the like. The controller 70 is capable of executing, during non-image formation, a setting mode in which the controller 70 causes the squeeze roller voltage source 74 and the developing roller voltage source 73 to generate a predetermined potential difference and sets a developing contrast and a fog-removing voltage depending on a detection result by the current detecting sensor 75. The developing contrast (ΔV_cont) is a potential difference between a potential of the image portion where the electrostatic member is formed on the photosensitive drum 20 (on the image bearing member) and a potential of the developing roller 31. The fog-removing voltage (ΔV_back) is a potential difference between a potential of a non-image portion where the electrostatic image is not formed on the photosensitive drum 20 and the potential of the developing roller 31. Further, the controller 70 causes, during image formation, at least one of the developing roller voltage source 73, the charger 21 and the laser exposure device 11 to generate the potential difference set in the setting mode.

In the setting mode, the controller 70 causes the squeeze roller voltage source 74 and the developing roller voltage source 73 to generate the predetermined potential difference and calculates the resistance value of the developing roller 31 depending on the known resistance value of the liquid developer carried on the developing roller 31 and the detection result by the current detecting sensor 75. Then, the controller 70 sets the developing contrast and the fog-removing voltage depending on the calculated resistance value of the developing roller 31. At this time, the controller 70 calculates the known resistance value of the liquid developer depending on the detection result of the developer concentration sensor 39*a*.

Further, in the setting mode, the controller 70 controls the film forming electrode voltage source 81 and the developing roller voltage source 73 so that the potential difference between the film forming electrode 33 and the developing roller 31 is 0. In this embodiment, during the image formation, the controller 70 causes the charger 21 and the laser exposure device 11 to generate the potential difference set in the setting mode.

Here, in the present specification, during image formation is the time (period) in which the toner image is formed on the photosensitive drum 20 on the basis of image information inputted from a scanner provided to the image forming apparatus 1 or from an external terminal such as a personal computer. Further, during non-image formation is the time (period) other than during image formation, and for example, before execution or after execution of an image forming job after main switch actuation, during pre-rotation, a sheet interval, during post-rotation in the image forming job, and the like. Incidentally, the image forming job is the following series of operations performed on the basis of a print instruction signal (image formation instruction signal). That is, the image forming job is the series of operations from a start of a preparatory operation (pre-rotation) necessary for carrying out the image formation until a preparatory operation (post-rotation) necessary for ending the image formation is completed through an image forming step. The sheet interval is a period corresponding to an interval between a toner image formed on a single sheet and a toner image formed on a subsequent single sheet in the case where the image formation is continuously carried out.

Next, an operation of the image forming apparatus 1 using the above-described developing device 30 will be described using FIG. 2 and FIG. 3. To the developing roller 31, a voltage of −400 V is applied by the developing roller voltage source 73. The toner concentration of the liquid developer in the developing liquid tank 32 is adjusted to about 5 wt % in the developer mixer 39, and the toner particles have negative electric charges. On the surface of the developing roller 31, the liquid developer is carried when the developing roller surface passes from the developing liquid tank 32 to the film forming electrode 33. At this time, to the film forming electrode 33, a voltage of −550 to −600 V is applied, so that most of the toner particles are attracted to the surface of the developing roller 31 by the potential difference between itself and the developing roller 31. The liquid developer is separated into a liquid developer carried by the surface of the developing roller 31 and a liquid developer flowing down to a rear surface of the film forming electrode 33 in the neighborhood of an exit between the developing roller 31 and the film forming electrode 33. At this time, the toner concentration of the liquid developer on the surface of the developing roller 31 is 10 to 15 wt %.

The liquid developer deposited on and carried by the surface of the developing roller 31 reaches the squeeze roller 34. To the squeeze roller 34, a voltage higher than the applied voltage of the developing roller 31 by 50 to 120 V is applied from the squeeze roller voltage source 74. That is, for example, when the applied voltage of the developing roller 31 is −400 V, the applied voltage of the squeeze roller 34 is −450 V to −520 V.

Figure 4:
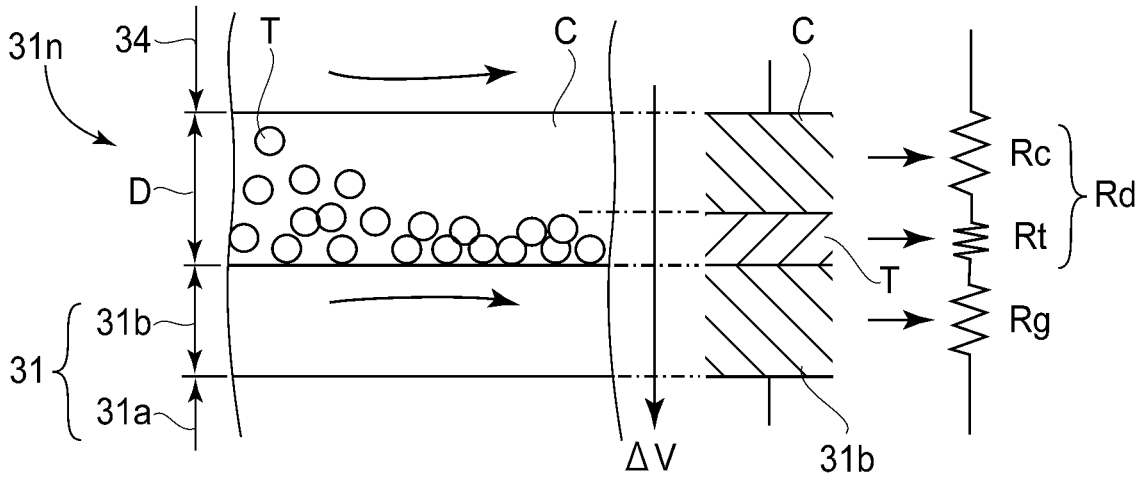
FIG. 4 is a schematic enlarged view showing a nip between a developing roller and a squeeze roller of the image forming apparatus according to the First Embodiment.

Here, motion of the toner in the nip 31*n* between the developing roller 31 and the squeeze roller 34 will be described using FIG. 4. The toner T contained in the liquid developer D carried on the developing roller 31 moves, during passing through between the nip 31*n* with the squeeze roller 34, toward the developing roller 31 side by the potential difference generated between the rollers 31 and 34. When the liquid developer D passes through between the squeeze roller 34 and the developing roller 31, the liquid developer D is deposited on and separated by both the rollers 34 and 31. At this time, the toner concentration of the liquid developer carried on the developing roller 31 is 25 to 35 wt %. On the other hand, the toner T is little attracted toward the squeeze roller 34, so that the carrier liquid C in which a content of the toner T is remarkably small is carried. As shown in FIG. 2, the carrier liquid carried by the squeeze roller 34 is scraped off and removed from the surface of the squeeze roller 34 by a squeeze roller blade 34*a* constituted by a rubber or the like in contact with the surface of the squeeze roller 34. The liquid developer carried by the surface of the developing roller 31 reaches the photosensitive drum 20.

The photosensitive drum 20 is charged to almost −600 V by applying a voltage of about −4.5 kV to −5.5 kV to a wire of the charger 21 on an upstream side of the developing nip with the developing roller 31. After charging, the latent image is formed so that a potential of an image portion is almost 200 V by the laser exposure device 11.

In the developing nip formed between the developing roller 31 and the photosensitive drum 20, the toner particles move in the following manner. The toner particles selectively move toward the image portion on the photosensitive drum 20 in accordance with an electric field formed by a bias of −400 V applied to the developing roller 31 and the latent image (image portion: −200 V, non-image portion: −600 V) on the photosensitive drum 20. By this, the toner image is formed on the photosensitive drum 20. The carrier liquid is not influenced by the electric field, and therefore, is separated at the exit of the developing nip between the developing roller 20 and the photosensitive drum 20 and is deposited on both the developing roller 31 and the photosensitive drum 20.

The toner image passed through the developing nip on the photosensitive drum 20 reaches a nip with the intermediary transfer belt 54, so that primary transfer is carried out. To the primary transfer roller 53, a voltage of about +200 V of an opposite polarity to a charging characteristic of the toner particles is applied, so that the toner on the photosensitive drum 20 is primary-transferred onto the intermediary transfer belt 54 and only the carrier liquid remains on the photosensitive drum 20. The carrier liquid remaining on the photosensitive drum 20 is scraped off by the cleaning blade 41 disposed downstream of the primary transfer portion and is collected by the drum cleaner 40.

The toner images primary-transferred onto the intermediary transfer belt 54 at the primary transfer portions are moved toward the secondary transfer unit 60 as shown in FIG. 1. In the secondary transfer unit 60, to the secondary transfer outer roller 62, a voltage of +1000 V is applied and the secondary transfer inner roller 61 is maintained at 0 V, so that the toner particles on the intermediary transfer belt 54 are secondary-transferred onto the sheet S. Incidentally, the liquid developer remaining on the intermediary transfer belt 54 after secondary transfer is collected by an unshown intermediary transfer belt cleaning member.

In an image forming process by the image forming apparatus 1 of this embodiment, movement (transfer) efficiency in each of toner moving processes is required to be almost 95% or more, which is very high. For that reason, during image formation, in each of the developing devices 30, it is important for stabilizing an image quality of the images, particularly a density that a proper potential difference is provided between the photosensitive drum 20 and the developing roller 31.

In the image forming process by the image forming apparatus 1 of this embodiment, in the developing device 30, the following procedure is executed for generating, during the image formation, the potential difference by executing the setting mode for setting the developing contrast and the fog removing voltage.

However, as described above, the volume resistivity of the surface layer 31*b* of the developing roller 31 is optimized by dispersing and mixing the ion conductive agent. However, with use of the developing roller 31, the ion conductive agent originally dispersed uniformly in the surface layer 31*b* causes localization, so that the volume resistivity of the surface layer 31*b* gradually increases. Accordingly, the electric resistance of the surface layer 31*b* of the developing roller 31 measured under a certain condition gradually increases with an increase in number of image formation sheets, as shown in FIG. 5.

Figure 5:
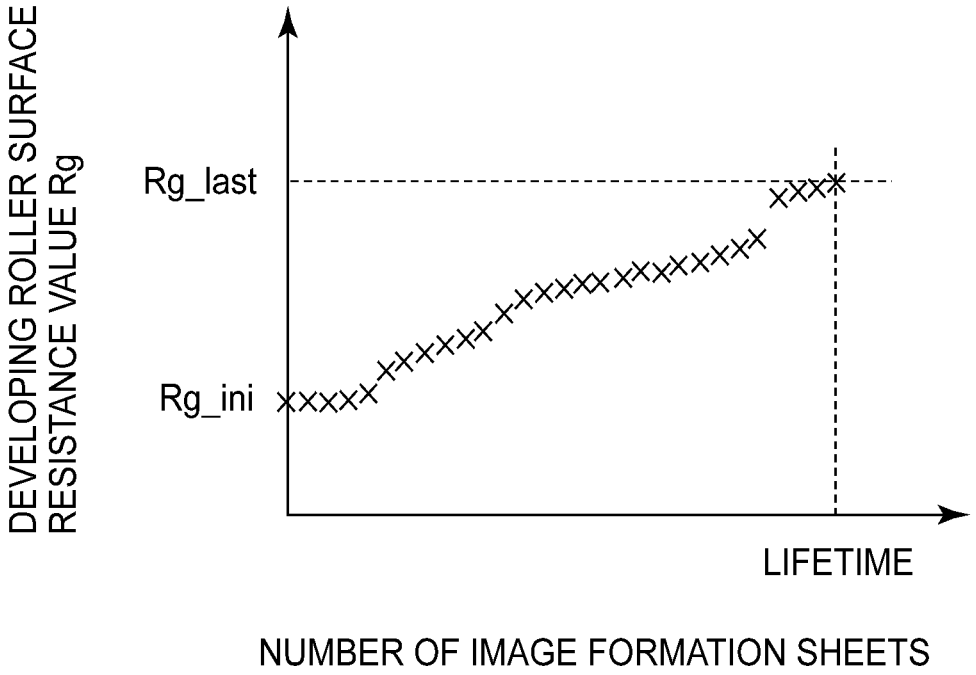
FIG. 5 is a graph showing a relationship between a number of image formation sheets and a resistance value of a surface layer of the developing roller in the image forming apparatus according to the first Embodiment.

Incidentally, in FIG. 5, Rg_ini is the resistance value Rg of the surface layer 31*b* of the developing roller 31 before use, and Rg_last is the resistance value Rg of the surface layer 31*b* of the developing roller 31, discriminated as being an end of the lifetime. In order to discriminate the toner concentration of the liquid developer carried on the developing roller 31 by the above-described method, there is a need to detect the resistance value Rg of the surface layer 31*b* of the developing roller 31.

In this embodiment, the liquid developer having a known toner concentration is periodically carried on the developing roller 31, and the resistance value Rg of the surface layer 31*b* of the developing roller 31 is acquired on the basis of a combination of a current generating during application of a certain voltage between the squeeze roller 34 and the developing roller 31 with information on the toner concentration. Next, in view of the acquired result, a flow in which a shearing voltage of the developing roller 31 in the developing nip is calculated and the developing contrast and the fog-removing voltage are controlled.

First, a procedure for calculating the resistance value Rg of the surface layer 31*b* of the developing roller 31 will be described. As shown in FIG. 4, in the nip 31*n* between the developing roller 31 and the squeeze roller 34, the squeeze roller 34 and the center shaft 31*a* of the developing roller 31 are made of metal and their resistance values are very small. On the other hand, the surface layer 31*b* of the developing roller 31 comprises an electroconductive polymer in which volume resistivity is adjusted, and includes a resistance component (resistance value Rg). Further, the liquid developer D existing between the developing roller 31 and the squeeze roller 34 includes a resistance component (resistance value Rc) in the carrier liquid C and a resistance component (resistance value Rt) in the toner T. On the basis of this, the liquid developer D and the surface layer 31*b* of the developing roller 31 can be represented as an equivalent circuit including the respective resistance components.

Here, the case where a certain voltage ΔV is applied to between the squeeze roller 34 and the developing roller 31 will be considered. The equivalent circuit shown in FIG. 4, a current I flowing between both the rollers 34 and 31 is determined by a total value of the resistance value Rg of the surface layer 31*b* of the developing roller 31, the resistance value Rc by the carrier liquid C and the resistance value Rt by the toner T. When the resistance value Rd of the liquid developer D is Rd=Rc+Rt, the resistance value Rg of the surface layer 31*b* of the developing roller 31 can be calculated using the following symbolic formula 1.

$$Rg=(\Delta V/I)-Rd \quad (1)$$

Figure 6:
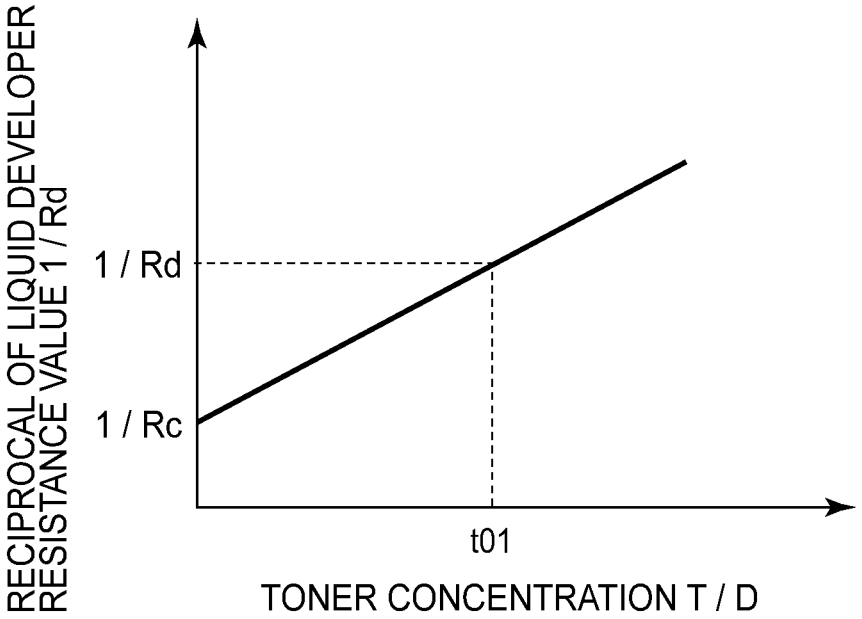
FIG. 6 is a graph showing a relationship between a toner concentration of a liquid developer and the reciprocal of a resistance value of the liquid developer in an image forming apparatus according to the First Embodiment.

From the symbolic formula 1, when the resistance value Rd of the liquid developer D is known, the current I flowing between both the rollers 34 and 31 is detected by applying the predetermined voltage ΔV to between the squeeze roller 34 and the developing roller 31, so that the resistance value Rg of the surface layer 31*b* of the developing roller 31 can be calculated. In the liquid developer, electrical conductivity (reciprocal of volume resistivity) of the toner particles is about $10^2$ times that of the carrier liquid. Electrical conductivity of the liquid developer increases substantially in proportion to a weight percentage concentration (T/D) [wt %] of the toner occupied in the entirety of the liquid developer, and therefore, the reciprocal 1/Rd of the resistance value of the developer measured by the method of this embodiment linearly increases relative to T/D of the developer as shown in FIG. 6. For that reason, when a slope of dependency of 1/Rd on T/D is a, the resistance value Rd of the developer is represented by the following symbolic formula.

$$Rd=1/\{(1/Rc)+a\cdot(T/D)\} \quad (2)$$

In this embodiment, the resistance value Rc of the carrier liquid and the slope a of the dependency of 1/Rc on T/D are grasped in advance. Further, T/D of the liquid developer in the developing liquid tank 32 is detected, as that of the liquid developer having the concentration which is known, using the developer concentration sensor 39*a*. Further, this is achieved by carrying out film formation of the liquid developer on the developing roller 31 without changing the concentration of the liquid developer in the developing liquid tank 32 by setting voltages so that the film forming electrode 33 and the developing roller 31 have the same potential. By these, the resistance value Rd of the liquid developer can be calculated using the symbolic formula 2, and from the resultant resistance value Rd of the liquid developer and the current I between the squeeze roller 34 and the developing roller 31, the resistance value Rg of the surface layer 31*b* of the developing roller 31 is calculated using the symbolic formula 1. Incidentally, the volume resistivity of the carrier liquid used in this embodiment is about $1\times10^{11}$ Ω·cm, and the resistance value measured in the system in this embodiment is about $3\times10^{6}$Ω.

Next, a relationship, in the developing nip of the developing roller 31, between the volume resistivity of the surface layer 31*b* of the developing roller 31 and the shearing voltage of the surface layer 31*b* of the developing roller 31 relative to the developing contrast and the fog-removing voltage will be described. The volume resistivity of the surface layer 31*b* of the developing roller 31 used in this embodiment is adjusted to 1 to $5\times10^{5}$ Ω·cm in the initial state as described above. On the other hand, T/D of the liquid developer in the developing nip is 30.0±5.0 wt %, and the volume resistivity thereof is about $5.0\times10^{10}$ Ω·cm. A gap of the developing nip is about 3 μm, and nip width is about 4 mm, so that a ratio of the shearing voltage of the surface layer 31*b* of the developing roller 31 to the developing contrast and the fog-removing voltage has dependency shown in FIG. 7 with respect to the volume resistivity of the surface layer 31*b* of the developing roller 31.

Figure 7:
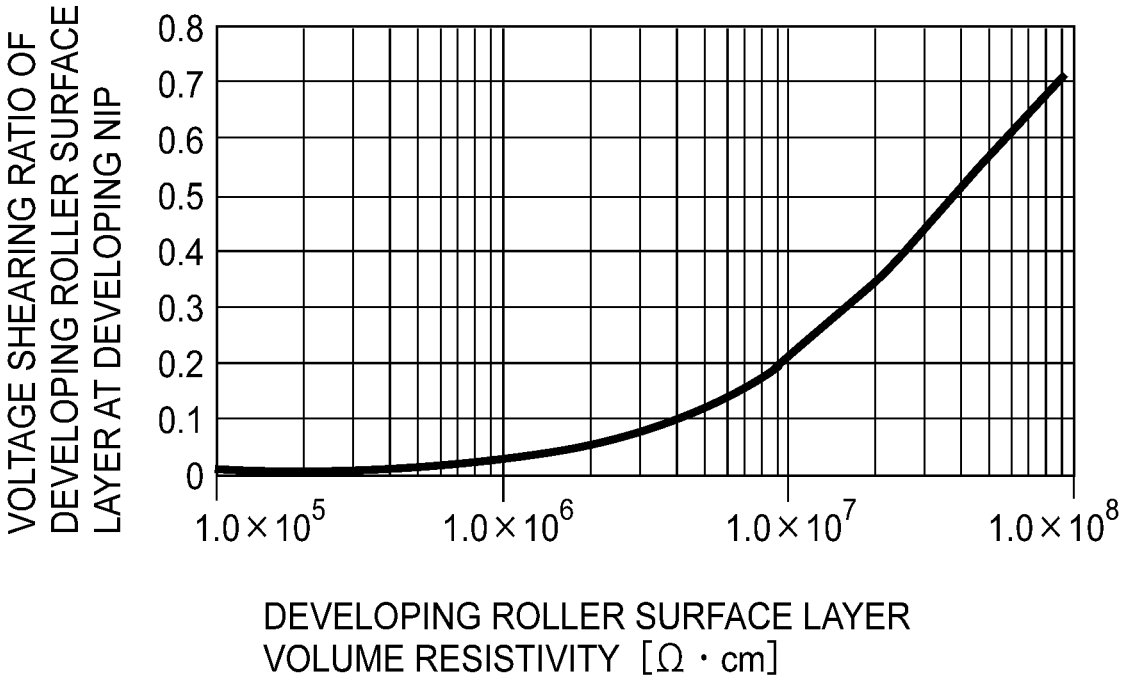
FIG. 7 is a graph showing a relationship between a resistivity of the surface layer of the developing roller and a ratio of voltage shearing in the image forming apparatus according to the First Embodiment.

As shown in FIG. 7, in the constitution of this embodiment, when the volume resistivity of the surface layer 31*b* of the developing roller 31 is larger than $4\times10^{6}$ Ω·cm, the ratio of the shearing voltage of the surface layer 31*b* of the developing roller 31 to the developing contrast and the fog-removing voltage exceeds 10%. In this case, an amount corresponding to a decrease relative to desired values of the developing contrast and the fog-removing voltage exhibits the influence on the image density or the fog. Therefore, in this embodiment, when the volume resistivity of the surface layer 31*b* of the developing roller 31 is $4\times10^{6}$ Ω·cm or less, the surface potentials of the photosensitive drum 20 are set at −200 V at the image portion and −600 V at the non-image portion which are initial setting. Specifically, the controller 70 controls the applied voltage to the charger 21 and an exposure amount at the laser exposure device 11, and causes the developing contrast and the fog-removing voltage to all in a range of 180-200 V.

On the other hand, in the case where the volume resistivity of the surface layer 31*b* of the developing roller 31 exceeds $4\times10^{6}$ Ω·cm, the controller 70 controls the image portion/non-image portion potentials on the photosensitive drum 20 depending on its value. By this, the controller 70 causes the developing contrast and the fog-removing voltage, between the surface layer 31*b* of the developing roller 31 and the image portion/non-image portion of the photosensitive drum 20 to effectively fall in the range of 180-200 V. Thus, in this embodiment, the controller 70 controls the voltage to be applied to the developing roller depending on the resistance of the developing roller so that the surface potential of the developing roller is a target value. Incidentally, in the constitution of this embodiment, when the volume resistivity of the surface layer 31*b* of the developing roller 31 is $4\times10^{6}$ Ω·cm, the resistance value Rg of the surface layer 31*b* of the developing roller 31 measured at the developing nip is $2.0\times10^{5}$Ω.

Figure 8:
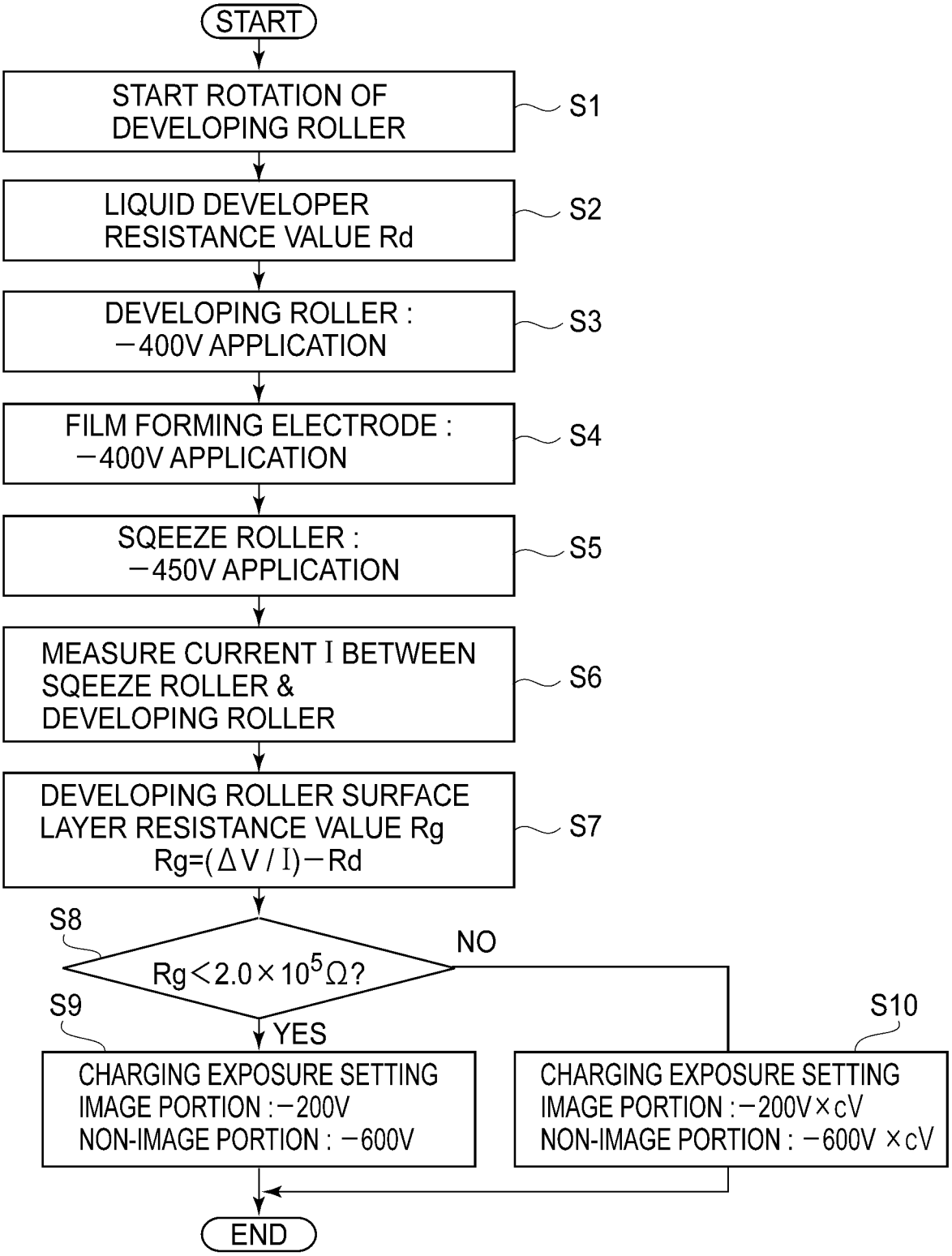
FIG. 8 is a flowchart showing a process procedure in the image forming apparatus according to the First Embodiment.

Next, a procedure in which the electric resistance of the surface layer 31*b* of the developing roller 31 in this embodiment is measured and the developing contrast and the fog-removing voltage is controlled will be described along a flowchart shown in FIG. 8. Incidentally, the resistance value Rg of the surface layer 31*b* of the developing roller 31 gently changes relative to a use time and a frequency of the developing roller 31. For that reason, execution of the setting mode may preferably be carried out at timing such as the time of a start of business operations of a day or after formation of many images or the like. Further, until the setting mode is subsequently carried out, the developing contrast and the fog-removing voltage stored in the last setting mode are used. Incidentally, in this embodiment, the setting mode is executed at the time of main switch actuation of the image forming apparatus 1 every morning.

After the start of the setting mode, the controller 70 starts rotation of the developing roller 31 (step S1). In this embodiment, a peripheral speed of the developing roller 31 is 785 mm/s. At this time, the squeeze roller 34 is contacted to the developing roller 31 through the liquid developer and rotates at the same speed as the developing roller 31.

The controller 70 detects T/D of the liquid developer in the developing liquid tank 32 by using the developer concentration sensor 39*a*, and calculates the resistance value Rd of the developer from the symbolic formula 2 by utilizing the known resistance value Rc of the carrier liquid and the slope a of 1/Rd vs. T/D (step S2). That is, the controller 70 acquires the known toner concentration of the liquid developer by detecting the toner concentration of the liquid developer (reference liquid developer) by the developer concentration sensor 39*a*. The controller 70 applies a voltage of −400 V to the developing roller 31 (step S3), and applies a voltage of −400 V, which is equal to the potential of the developing roller 31, to the film forming electrode 33 (step S4). At this time, the film forming electrode 33 has no potential difference relative to the developing roller 31, and therefore, the toner contained in the liquid developer passing through therebetween is not electrically shifted toward either of the members, and passes through between the developing roller 31 and the film forming electrode 33 while T/D of the developer is kept uniform and is separated. Therefore, T/D of the developer subsequently passing and reaching the nip 31*n* between the squeeze roller 34 and the developing roller 31 is equal to T/D of the developer in the developing liquid tank 32.

The controller 70 applies a voltage of −450 to the squeeze roller 34 (step S5), and measures a current I generating between the squeeze roller 34 and the developing roller 31 by the current detecting sensor 75 (step S6). The measured current I is sent as digital information to the CPU 71 through the A/D converter 76. The CPU 71 makes reference to the resistance value Rd calculated in the step S2, and calculates the resistance value Rg of the surface layer 31*b* of the developing roller 31 by using the symbolic formula 2 (step S7).

The controller 70 discriminates whether or not the calculated resistance value Rg of the surface layer 31*b* is smaller than $2.0\times10^5\Omega$ (step S8). Here, the reason why the resistance value Rg is compared with $2.0\times10^5\Omega$ is that as shown in FIG. 7, $2.0\times10^5\Omega$ (volume resistivity of $4\times10^6$ Ω·cm) is a threshold of adjustment of the developing contrast and the fog-removing voltage. In the case where the controller 70 discriminated that the resistance value Rg of the surface layer 31*b* is smaller than $2.0\times10^5\Omega$ (when the resistance value Rg is a first resistance value), the controller 70 makes setting so that the surface potentials of the photosensitive drum 20 are −200 V at the image portion and −600 V at the non-image portion which are initial setting (step S9). That is, the controller 70 sets the applied voltage to the charger 21 and the exposure amount at the laser exposure device 11.

On the other hand, in the case where the resistance value Tg of the surface layer 31*b* is $2.0\times10^5\Omega$ or more (when the resistance value Rg is a second resistance value), the controller 70 makes setting so that the surface potentials of the photosensitive drum 20 are −200×c [V] at the image portion and −600×c [V] at the non-image portion (step S10). Here, a coefficient c is a coefficient for the resistance value Rg of the surface layer 31*b* stored in the memory 72 in advance in order to use in the case where the resistance value Rg of the surface layer 31*b* of the developing roller 31 is larger than the threshold. In this embodiment, the potential (absolute value) of the surface of the developing roller becomes small by resistance rise of the surface layer. For that reason, in order to make the developing contrast and a contrast of the fog-removing voltage predetermined values, the coefficient c satisfies a relationship of $0<c<1$. For that reason, an absolute value of the image portion potential and an absolute value of the non-image portion potential become small compared with those before change, respectively. In this embodiment, after the potentials of the image portion and the non-image portion are set, the process ends. Incidentally, in this embodiment, the potentials of the image portion and the non-image portion are multiplied by the same coefficient c, but a constitution in which the potentials of the image portion and the non-image portion are multiplied by different coefficients may also be employed.

As described above, according to the image forming apparatus 1 of this embodiment, during non-image formation, the controller 70 causes the squeeze roller voltage source 74 and the developing roller voltage source 73 to generate the predetermined potential difference. Then, depending on the detection result by the current detecting sensor 75, the controller 70 is capable of executing the setting mode for setting the developing contrast and the fog-removing voltage. Further, during the image formation, the controller 70 causes the charger 21 and the laser exposure device 11 to generate the potential difference set in the setting mode. For this reason, the proper developing contrast and the proper fog-removing voltage can be acquired, so that it is possible to suppress the occurrence of the image defects such as the insufficient density and the fog in the image formation. By this, in the image forming apparatus 1 using the liquid developing system, even use for the long period, the occurrence of the image defects can be suppressed.

That is, in the image forming apparatus 1 of the liquid developing type, the value of the current flowing through between both the rollers 31 and 34 when the predetermined potential difference is generated between the developing roller 31 and the squeeze roller 34 contacting the developing roller 34. On the basis of the detection result thereof, the resistance value Rg of the surface layer 31*b* of the developing roller 31 can be discriminated. Further, by using a discrimination result, it becomes possible to properly control the developing contrast and the fog-removing voltage which are effectively applied at the developing nip during the image formation.

According to the image forming apparatus 1 of this embodiment, as a roller member contacting the developing roller 31, the squeeze roller 34 is used, so that there is no need to provide the exclusive member. For that reason, the developing contrast and the fog-removing voltage can be measured and controlled with accuracy without causing upsizing of the apparatus and an increase in initial cost.

Second Embodiment

Figure 9:
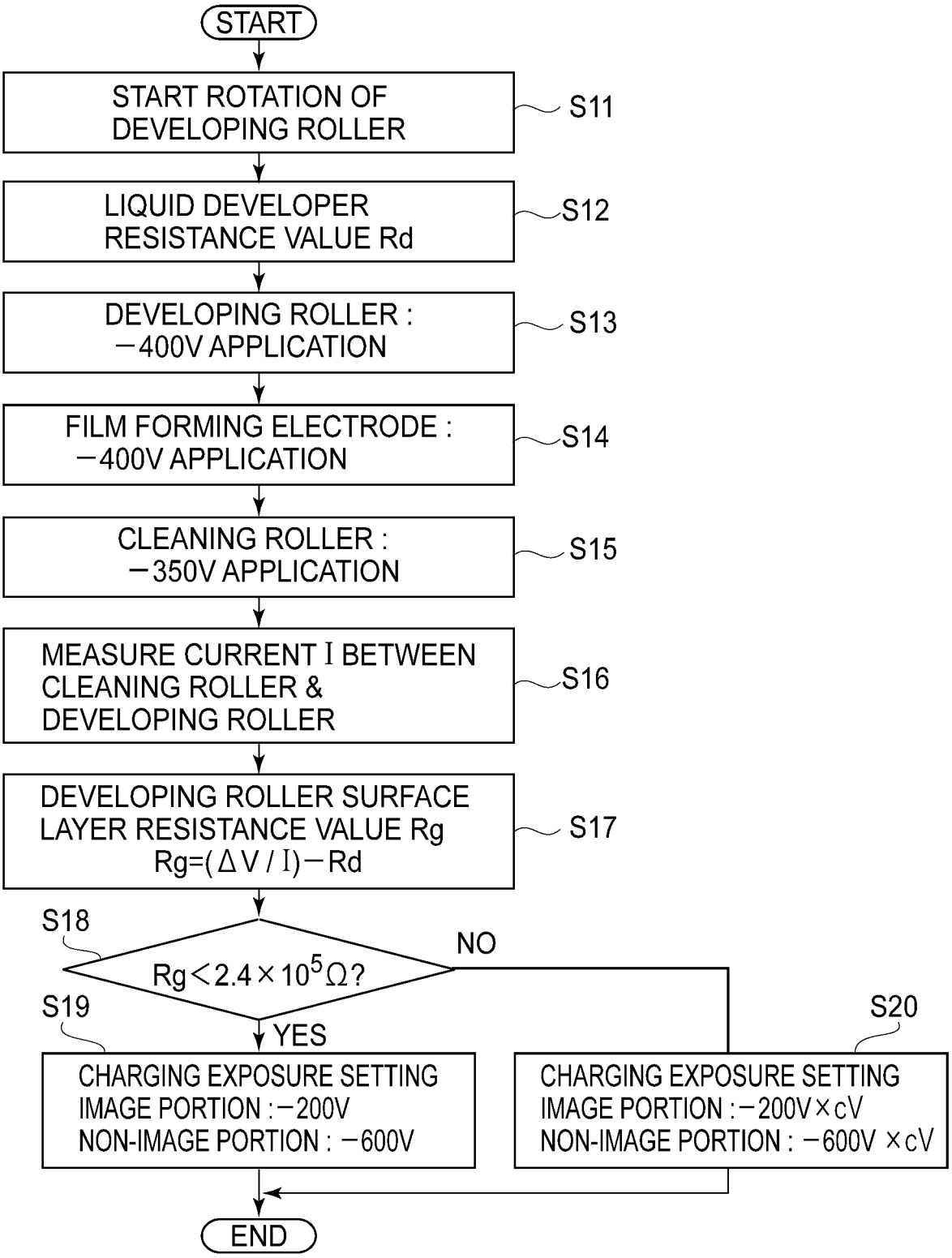
FIG. 9 is a flowchart showing a process procedure in the image forming apparatus according to a Second Embodiment.

Next, the Second Embodiment of the present invention will be specifically described while making reference to FIG. 9. In this embodiment, a constitution is different from a constitution of the First Embodiment in which the squeeze roller 34 is applied, in that the cleaning roller 35 is applied as the electroconductive member. With this, the constitution of this embodiment is different from the constitution of the First Embodiment in that the cleaning roller voltage source 78 and the developing roller voltage source 73 are applied as the first voltage applying means and that the current detecting sensor 79 is applied as the current detecting means. That is, in this embodiment, control of the developing contrast and the fog-removing voltage is carried out by calculating the toner concentration of the liquid developer carried on the developing roller 31 through calculation of the current when a certain voltage is applied to between the developing roller 31 and the cleaning roller 35 and by measuring the resistance value Rg of the surface layer 31*b* of the developing roller 31, on the basis of the result. However, other constitutions are similar to those of the First Embodiment, so that the same symbols are used and detailed description will be omitted.

In this embodiment, a resistance measuring method of the surface layer 31*b* of the developing roller 31 uses the cleaning roller 35 in place of the squeeze roller 34 relative to the method in the First Embodiment. In the constitution of this embodiment, when the volume resistivity of the surface layer 31*b* of the developing roller 31 is $4\times10^6$ Ω·cm, the resistance value Rg of the surface layer 31*b* of the developing roller 31 measured between the developing roller 31 and the cleaning roller 35 is $2.4\times10^5\Omega$.

Next, a procedure in which the electric resistance of the surface layer 31*b* of the developing roller 31 in this embodiment is measured and the developing contrast and the fog-removing voltage is controlled will be described along a flowchart shown in FIG. 9. After the start of the setting mode, the controller 70 starts rotation of the developing roller 31 (step S11). In this embodiment, a peripheral speed of the developing roller 31 is 785 mm/s. At this time, the squeeze roller 34 is contacted to the developing roller 31 through the liquid developer and rotates at the same speed as the developing roller 31.

The controller 70 detects T/D of the liquid developer in the developing liquid tank 32 by using the developer concentration sensor 39*a*, and calculates the resistance value Rd of the developer from the symbolic formula 2 by utilizing the known resistance value Rc of the carrier liquid and the slope a of 1/Rd vs. T/D (step S12). The controller 70 applies a voltage of −400 V to the developing roller 31 (step S13), and applies a voltage of −400 V, which is equal to the potential of the developing roller 31, to the film forming electrode 33 (step S14). At this time, the film forming electrode 33 has no potential difference relative to the developing roller 31, and therefore, the toner contained in the liquid developer passing through therebetween is not electrically shifted toward either of the members, and passes through between the developing roller 31 and the film forming electrode 33 while T/D of the developer is kept uniform and is separated. Therefore, T/D of the developer subsequently passing and reaching the nip 31*n* between the squeeze roller 34 and the developing roller 31 is equal to T/D of the developer in the developing liquid tank 32.

The controller 70 applies a voltage of −350V to the cleaning roller 35 (step S15), and measures a current I generating between the cleaning roller 35 and the developing roller 31 by the current detecting sensor 79 (step S16). The measured current I is sent as digital information to the CPU 71 through the A/D converter 80. The CPU 71 makes reference to the resistance value Rd calculated in the step S12, and calculates the resistance value Rg of the surface layer 31*b* of the developing roller 31 by using the symbolic formula 2 (step S17).

The controller 70 discriminates whether or not the calculated resistance value Rg of the surface layer 31*b* is smaller than $2.4\times10^5\Omega$ (step S18). In the case where the controller 70 discriminated that the resistance value Rg of the surface layer 31*b* is smaller than $2.4\times10^5\Omega$, the controller 70 makes setting so that the surface potentials of the photosensitive drum 20 are −200 V at the image portion and −600 V at the non-image portion which are initial setting (step S19). That is, the controller 70 sets the applied voltage to the charger 21 and the exposure amount at the laser exposure device 11.

On the other hand, in the case where the resistance value Tg of the surface layer 31*b* is $2.4\times10^5\Omega$ or more, the controller 70 makes setting so that the surface potentials of the photosensitive drum 20 are −200×c [V] at the image portion and −600×c [V] at the non-image portion (step S20). Here, a coefficient c is a coefficient for the resistance value Rg of the surface layer 31*b* stored in the memory 72 in advance in order to use in the case where the resistance value Rg of the surface layer 31*b* of the developing roller 31 is larger than the threshold. In this embodiment, the potential (absolute value) of the surface of the developing roller becomes small by resistance rise of the surface layer. For that reason, in order to make the developing contrast and a contrast of the fog-removing voltage predetermined values, the coefficient c satisfies a relationship of $0<c<1$. For that reason, an absolute value of the image portion potential and an absolute value of the non-image portion potential become small compared with those before change, respectively. In this embodiment, after the potentials of the image portion and the non-image portion are set, the process ends. Incidentally, in this embodiment, the potentials of the image portion and the non-image portion are multiplied by the same coefficient c, but a constitution in which the potentials of the image portion and the non-image portion are multiplied by different coefficients may also be employed.

As described above, according to the image forming apparatus 1 of this embodiment, during non-image formation, the controller 70 causes the cleaning roller voltage source 78 and the developing roller voltage source 73 to generate the predetermined potential difference. Then, depending on the detection result by the current detecting sensor 79, the controller 70 is capable of executing the setting mode for setting the developing contrast and the fog-removing voltage. Further, during the image formation, the controller 70 causes the charger 21 and the laser exposure device 11 to generate the potential difference set in the setting mode. For this reason, the proper developing contrast and the proper fog-removing voltage can be acquired, so that it is possible to suppress the occurrence of the image defects such as the insufficient density and the fog in the image formation. By this, in the image forming apparatus 1 using the liquid developing system, even use for the long period, the occurrence of the image defects can be suppressed.

In the image forming apparatus 1 of the above-described Second Embodiment, the case where the cleaning roller 35 is applied as the electroconductive member was described, but the present invention is not limited thereto. For that reason, the mode is not carried out using the cleaning roller 35 alone but is used in combination with the First Embodiment, and is used in an assisting manner, so that the toner concentration of the liquid developer carried on the developing roller 31 can be more finely controlled. In this case, a plurality of electroconductive members are provided, and the electroconductive members are the squeeze roller 34 and the cleaning roller 35.

Further, in the image forming apparatuses 1 of the First and Second Embodiments, as the electroconductive member at least one of the squeeze roller 34 and the cleaning roller 35 is applied, but the present invention is not limited thereto. As the electroconductive member, other than these, other members adjacent to the developing roller 31 may also be utilized as electrodes, and for example, the film forming electrode 33 and the photosensitive drum 20 may also be applied. In the case where the photosensitive drum 20 is applied, an unshown current detecting sensor for detecting the current flowing through between the developing roller 31 and the photosensitive drum 20 is provided. Then, during the non-image formation, the controller 70 causes the developing roller voltage source 73 to generate a predetermined potential source, and is capable of executing the setting mode for setting the developing contrast and the fog-removing voltage depending on the detection result by the current detecting sensor. Further, during the image formation, the controller 70 causes the charger 21 and the laser exposure device 11 to generate the potential difference set in the setting mode.

Further, in the First and Second Embodiments, the case where as regards the developing contrast and the fog-removing voltage which are set in the setting mode, during the image formation, the controller 70 causes the charger 21 and the laser exposure device 11 to generate the potential difference set in the setting mode was described. However, the present invention is not limited thereto, but the potential difference may only be required to be generated by at least one of the voltage applying means, the charger 21 and the laser exposure device 11. That is, the developing bias is controlled by controlling the voltage applying means, whereby the developing contrast and the fog-removing voltage may also be adjusted.

In the above-described constitution, a constitution in which the image portion potential and the non-image portion potential are switched by the resistance value of the developing roller 31 was employed. As another constitution, a constitution in which in the case where an amount of use of the developing roller 31 exceeds a predetermined amount, the image portion potential and the non-image portion potential are switched by the above-described method may also be employed. Specifically, in the case where the use amount of the developing roller 31 exceeds 80% of the use amount set for the developing roller 31, the image portion potential and the non-image portion potential are switched by a method similar to the above-described method.

Embodiment 1

By utilizing the image forming apparatus 1 of the above-described First Embodiment, solid images of 10%, in image ratio were printed for durability, and adjustment of the developing contrast and the fog-removing voltage was carried out every image formation of 10,000 sheets, and how the solid image density and the fog change was checked every 50,000 sheets. Here, image formation was carried out in a condition in which applied voltages to developing roller 31/squeeze roller 34/cleaning roller 35 were −400/−450/−350 V, respectively. Further, in image evaluation, a solid portion density and a fog density of a white background portion were measured every 50,000 sheets by a reflection densitometer (manufactured by X-Rite Inc.) A result thereof is shown in FIG. 10. As shown in FIG. 10, by using the method of this embodiment, it was confirmed that the image density and the fog can be properly maintained over a long term.

Embodiment 2

By utilizing the image forming apparatus 1 of the above-described Second Embodiment, similarly as in Embodiment 1, solid images of 10%, in image ratio were printed for durability, and how the solid image density and the fog change was checked. Incidentally, an image forming condition and a measuring means of the image density were similar to those in Embodiment 1. A result thereof is shown in FIG. 10. As shown in FIG. 10, according to the image forming apparatus 1 of Embodiment 2, by the Second Embodiment, it was confirmed that the image density and the fog can be properly maintained over a long term.

Comparison Example

An image forming apparatus in which the control as in the First and Second Embodiments is not executed was used. By utilizing this image forming apparatus 1, similarly as in Embodiment 1, solid images of 10%, in image ratio were printed for durability, and how the solid image density and the fog change was checked. A result thereof is shown in FIG. 10. As shown in FIG. 10, in the image forming apparatus of the comparison example, the image density was lowered and the fog density was increased with an increase in number of image formation sheets. For this reason, different from Embodiments 1 and 2, it was confirmed that the image density and the fog cannot be properly maintained over a long term.

INDUSTRIAL APPLICABILITY

According to the present invention, the present invention relates to an image forming apparatus in which the electrostatic image is developed by the wet developing type with use of the liquid developer in which the toner is dispersed in the medium liquid.

EXPLANATION OF SYMBOLS

1 . . . image forming apparatus, 11, 11*c*, 11*k*, 11*m*, 11*y* . . . laser exposure device (exposure means), 20, 20*c*, 20*k*, 20*m*, 20*y* . . . photosensitive drum (image bearing member), 21, 21*c*, 21*k*, 21*m*, 21*y* . . . charger (charging means), 31 . . . developing roller (developer carrying member), 33 . . . film forming electrode (toner concentration adjusting means), 34 . . . squeeze roller (electroconductive member), 35 . . . cleaning roller (electroconductive member), 39*a* . . . developer concentration sensor (toner concentration detecting means), 70 . . . controller, 73 . . . developing roller voltage source (first voltage applying means, second voltage applying means, third voltage applying means, voltage applying means), 74 . . . squeeze roller voltage source (first voltage applying means), 75 . . . current detecting sensor (current detecting means), 78 . . . cleaning roller voltage source (first voltage applying means), 79 . . . current detecting sensor (current detecting means), 81 . . . film forming electrode voltage source (third voltage applying means), C . . . carrier liquid, D . . . liquid developer, T . . . toner.

The invention claimed is:

1. An image forming apparatus comprising:

an image bearing member;

a charging device for electrically charging said image bearing member;

an exposure device for exposing said charged image bearing member to light to form an electrostatic latent image on said image bearing member;

a developing device including an electroconductive developing roller for carrying and feeding a liquid developer containing toner and a carrier liquid to a developing position where the electrostatic latent image formed on said image bearing member is developed, an elastic layer being formed on a surface of said developing roller, a developer container for accommodating the liquid developer to be supplied to said developing roller, and an electroconductive member in contact with said developing roller;

a voltage applying portion for forming a potential difference between said developing roller and said electroconductive member;

a current detecting portion for detecting a current flowing between said developing roller and said electroconductive member; and a controller for performing a mode, in which an image portion potential is controlled during image formation so that an absolute value of the image portion potential is a first value in a case in which a resistance value of said developing roller based on a value of a current flowing between said developing roller and said electroconductive member is smaller than a predetermined value when a predetermined potential difference between said developing roller and said electroconductive member is formed during non-image formation and so that an absolute value of the image portion potential is a second value smaller than the first value in a case in which a resistance value of said developing roller based on a value of current flowing between said developing roller and said electroconductive member is not smaller than the predetermined value when the predetermined potential difference between said developing roller and said electroconductive member is formed during non-image formation.

2. An image forming apparatus according to claim 1, wherein in the mode an absolute value of the potential of said developing roller when the absolute value of the image portion potential is the first value in a case in which the resistance value of said developing roller is smaller than the predetermined value is equal to the absolute value of the potential of said developing roller when the absolute value of the image portion potential is the second value in a case in which the resistance value of said developing roller is not smaller than the predetermined value.

3. An image forming apparatus according to claim 1, wherein said controller performs the mode in which a non-image portion potential is controlled during image formation so that an absolute value of the image portion potential is a third value in a case in which the resistance value of said developing roller based on the value of current flowing between said developing roller and said electroconductive member is smaller than the predetermined value when the predetermined potential difference between said developing roller and said electroconductive member is formed during non-image formation and so that an absolute value of the image portion potential is a forth value smaller than the third value in a case in which the resistance value of said developing roller based on a value of current flowing between said developing roller and said electroconductive member is not smaller than the predetermined value when the predetermined potential difference between said developing roller and said electroconductive member is formed during non-image formation.

4. An image forming apparatus according to claim 1, wherein said electroconductive member is disposed downstream of a supplying position on said developing roller where the liquid developer is supplied from said developer container thereto and upstream of the developing position with respect to a rotational direction of said developing roller.

5. An image forming apparatus according to claim 4, wherein said electroconductive member includes a squeeze roller for regulating a volume of the liquid developer carried on said developing roller.

6. An image forming apparatus according to claim 5, wherein the predetermined value is $2.0\times10^5\Omega$.

7. An image forming apparatus according to claim 1, wherein said electroconductive member is disposed downstream of the developing position and upstream of a supplying position on said developing roller where the liquid developer is supplied from said developer container thereto with respect to a rotational direction of said developing roller.

8. An image forming apparatus according to claim 7, wherein said electroconductive member includes a cleaning roller for removing the toner of the liquid developer carried on said developing roller.

9. An image forming apparatus according to claim 8, wherein the predetermined value is $2.4\times10^5\Omega$.

10. An image forming apparatus comprising:

an image bearing member;

a charging portion for electrically charging said image bearing member;

an exposure device for exposing said charged image bearing member to light to form an electrostatic latent image on said image bearing member;

a developing device including an electroconductive developing roller for carrying and feeding a liquid developer containing toner and a carrier liquid to a developing position where the electrostatic latent image formed on said image bearing member is developed, an elastic layer being formed on a surface of said developing roller, a developer container for accommodating the liquid developer to be supplied to said developing roller, and an electroconductive member in contact with said developing roller;

a voltage applying portion for forming a potential difference between said developing roller and said electroconductive member;

a current detecting portion for detecting a current flowing between said developing roller and said electroconductive member; and a controller for performing a mode, in which a non-image portion potential is controlled during image formation so that an absolute value of the non-image portion potential is a first value in a case in which a resistance value of said developing roller based on a value of current flowing between said developing roller and said electroconductive member is smaller than a predetermined value when a predetermined potential difference between said developing roller and said electroconductive member is formed during non-image formation and so that an absolute value of the non-image portion potential is a second value smaller than the first value in a case in which a resistance value of said developing roller based on a value of current flowing between said developing roller and said electroconductive member is not smaller than the predetermined value when the predetermined potential difference between said developing roller and said electroconductive member is formed during non-image formation.

11. An image forming apparatus according to claim 10, wherein in the mode an absolute value of the potential of said developing roller when the absolute value of the non-image portion potential is the first value in a case in which the resistance value of said developing roller is smaller than the predetermined value is equal to the absolute value of the potential of said developing roller when the absolute value of the non-image portion potential is the second value in a case in which the resistance value of said developing roller is not smaller than the predetermined value.

12. An image forming apparatus according to claim 10, wherein said electroconductive member is disposed downstream of a supplying position on said developing roller where the liquid developer is supplied from said developer container thereto and upstream of the developing position with respect to a rotational direction of said developing roller.

13. An image forming apparatus according to claim 12, wherein said electroconductive member includes a squeeze roller for regulating a volume of the liquid developer carried on said developing roller.

14. An image forming apparatus according to claim 13, wherein the predetermined value is $2.0\times10^5\Omega$.

15. An image forming apparatus according to claim 10, wherein said electroconductive member is disposed downstream of the developing position and upstream of a supplying position on said developing roller where the liquid developer is supplied from said developer container thereto with respect to a rotational direction of said developing roller.

16. An image forming apparatus according to claim 15, wherein said electroconductive member includes a cleaning roller for removing the toner of the liquid developer carried on said developing roller.

17. An image forming apparatus according to claim 16, wherein the predetermined value is $2.4\times10^5\Omega$.

* * * * *